United States Patent [19]

Cates et al.

[11] Patent Number: 4,710,200

[45] Date of Patent: Dec. 1, 1987

[54] PROCESS FOR THE CONTINUOUS DYEING OF POLY(M-PHENYLENE-ISOPHTHALAMIDE) FIBERS

[75] Inventors: Barbara J. Cates; Tanya E. FitzGerald, both of Greensboro, N.C.

[73] Assignee: Burlington Industries, Inc., Greensboro, N.C.

[21] Appl. No.: 863,038

[22] Filed: May 14, 1986

[51] Int. Cl.[4] ..... C09B 67/00

[52] U.S. Cl. ..... 8/574; 8/130.1; 8/543; 8/578; 8/586; 8/587; 8/611; 8/617; 8/925

[58] Field of Search ..... 8/574, 586, 587, 130.1

[56] References Cited

U.S. PATENT DOCUMENTS

| | | | |
|---|---|---|---|
| 2,225,603 | 12/1940 | Lubs | 8/402 |
| 2,290,945 | 7/1942 | Dahlen et al. | 8/564 |
| 2,989,360 | 6/1961 | Mautner | 8/553 |
| 3,558,267 | 1/1971 | Langenfeld | 8/586 |
| 3,741,719 | 6/1973 | Ramanathan et al. | 8/654 |
| 3,771,949 | 11/1973 | Hermes | 8/492 |
| 3,837,802 | 9/1974 | Litzler et al. | 8/549 |
| 3,884,626 | 5/1975 | Hoster et al. | 8/543 |
| 3,986,827 | 10/1976 | Dombchik | 8/527 |
| 4,059,403 | 11/1977 | Wolf et al. | 8/538 |
| 4,066,396 | 1/1978 | Wolf et al. | 8/489 |
| 4,525,168 | 6/1985 | Kelly | 8/130.1 |

FOREIGN PATENT DOCUMENTS 1282113 7/1972 United Kingdom .

OTHER PUBLICATIONS

"Dyeability of Nomex Aramid Yarn", by R. A. F. Moore et al, *Textile Research Journal,* pp. 254–260, 1985.

"Effect of Auxiliary Solvents in STX Coloration of Aramids and PBI with Cationic Dyes", in *Book of Papers, AATCC National Technical Conference, Oct. 1983, pp. 314–326.*

"Dyeing and Finishing Nomex Type 450 Aramid", *Bulletin NX-9,* Mar. 1978.

"Interactions of Nonaqueous Solvents with Textile Fibers, Part XI: Nomex Shrinkage Behavior", *Textile Res. J.,* 51, 323–331, (1981).

"Dyeability of Solvent Treated Fibers", *Book of Papers, AATCC National Technical Conference,* Moore et al, Oct. 1981, pp. 109–120.

"Interactions of Nonaqueous Solvents with Textile Fibers, Part II: Isotherman Shrinkage Kinetics of a Polyester Yarn", *Textile Res. J.,* 43, 176–183, (1973), Ribnick et al.

"Interaction of Nonaqueous Solvents with Textile Fibers, Part III: The Dynamic Shrinkage of Polyester Yarns in Organic Solvents", *Textile Res. J.,* 43, 316–325, (1973), Ribnick et al.

"Interaction of Nonaqueous Solvents with Textile Fibers, Part VII: Dyeability of Polyester Yarns After Heat and Solvent-Induced Structural Modifications", *Textile Res. J.,* 46, 574–587, (1976), Weigmann et al.

*Primary Examiner*—A. Lionel Clingman

*Attorney, Agent, or Firm*—Nixon & Vanderhye

[57] ABSTRACT

Continuous dyeing of poly(m-phenyleneisophthalamide) fibers using a swelling agent to introduce a dye into the fiber. The dyed fiber has properties of strength and fire retardance approximating the original undyed fiber and is conveniently dyed to an unlimited range of colors with high color yield and relatively good lightfastness at a resonable cost. An aqueous dimethylsulfoxide solution is used as the swelling agent.

24 Claims, 5 Drawing Figures

PROCESS FOR THE CONTINUOUS DYEING OF POLY(M-PHENYLENE-ISOPHTHALAMIDE) FIBERS

This invention relates to a dyeing of aramid fibers, especially poly(m-phenyleneisophthalamide) fibers, and more particularly to the continuous dyeing of poly(m-phenyleneisophthalamide) fibers in which the dye is introduced into the fiber while the fiber is in a solvent-swollen state.

Aramid fibers are highly resistant to heat decomposition, have inherent flame retardant properties and are frequently used in working wear for special environments where flame retardant properties are required. Fabrics made of these fibers are extremely strong and durable, and have been widely adopted for use in the protective clothing field, particularly for military applications where personnel have the potential to be exposed to fire and flame, such as aircraft pilots, tank crews and the like. Meta-linked aromatic polyamide fibers (aramid fibers) are made from high molecular weight polymers that are highly crystalline and have either a high or no glass transition temperature.

These inherent desirable properties of aramid fibers also create difficulties for fiber processing in other areas; specifically, aramids are difficult to dye. Fiber suppliers currently recommend a complicated exhaust dyeing procedure with a high carrier (acetophenone) content; the process is conducted at high temperatures over long periods of time and often results in a product having an unpleasant odor. Such dyeing conditions require substantial amounts of energy both to maintain dyeing temperature and for the treatment of waste dye baths. Polar organic solvents have also been used to swell the fiber or create voids in the fiber structure to enhance dyeability. These procedures involve solvent exhaust treatments at elevated temperatures with subsequent dyeing.

Another source of dyed aramid fiber is solution dyed aramid yarn, available from the fiber producer, prepared by solution dyeing in which a quantity of dye or pigment is mixed with the molten resin prior to extrusion of the resin into fine fibers; the dye or pigment becomes part of the fiber structure. Solution dyed fibers are more costly than the undyed fibers due, in part, to the additional costs of manufacture, and must be used in the color provided by the supplier leaving the weaver with only a limited choice of colors. Solution dyed fibers offer relatively good lightfastness whereas some undyed aramid fibers, particularly NOMEX, yellow following exposure to UV light. Because of this potential for yellowing, deep, rich colorations, particularly dark blue and navy blue, are achievable but still lack acceptable lightfastness.

More recently, a process has been described in U.S. Pat. No. 4,525,168 in which acid or anionic dyes are introduced into aramid fibers by coupling the dye to a dye site receptor which, in turn, is attached to the fiber. The process includes first swelling the fiber in a strong polar solvent and, while in the swollen condition, introducing a substance capable of forming a strong chemical bond with an anionic dye into the swollen fiber. This dye site receptor substance is an amine, typically hexamethylenediamine. The procedure described requires at least 3 steps, first pretreating the fiber in a solution of solvent/swelling agent, the diamine and a wetting agent, then drying to shrink the fiber and incorporate the diamine dye site receptor into the fiber. The thus pretreated fabric is then dyed with an anionic dye. Aramid fibers described and purported to be successfully dyed in U.S. Pat. No. 4,198,494 are sold under the trademarks NOMEX and KEVLAR by duPont, and under the trademark CONEX by Teijin Limited of Tokyo, Japan.

It is an object of the present invention to provide a continuous process for dyeing a dyeable, compatible aromatic polyamide fiber that will yield acceptable colorfastness without detracting from the inherent flame resistance and strength properties of the aramid fibers. Another object of this invention is to provide a continuous process adapted to dye large quantities of compatible aromatic polyamide fabric on a commercial scale at less cost than prior procedures.

BRIEF DESCRIPTION OF THE DRAWINGS

The process of the invention may take several forms, as illustrated in the attached drawings, in which.

SUMMARY OF THE INVENTION

Figure 1:
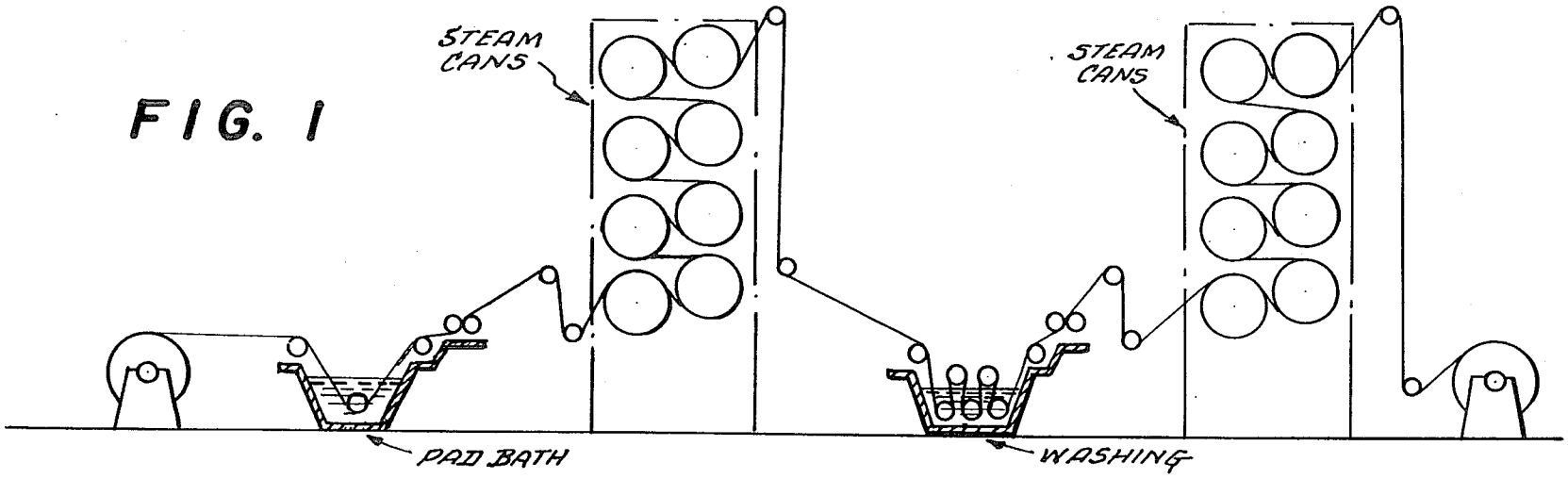
FIG. 1 is a schematic illustration of a process of applying the dye and swelling agent from a hot pad bath to a poly(m-phenyleneisophthalamide)-containing fabric, fixing the dye and drying the fabric over a stack of steam cans, washing to remove any residual swelling agent, drying the fabric on a second set of steam cans, and taking the dyed fabric up on a roll.
Figure 2:
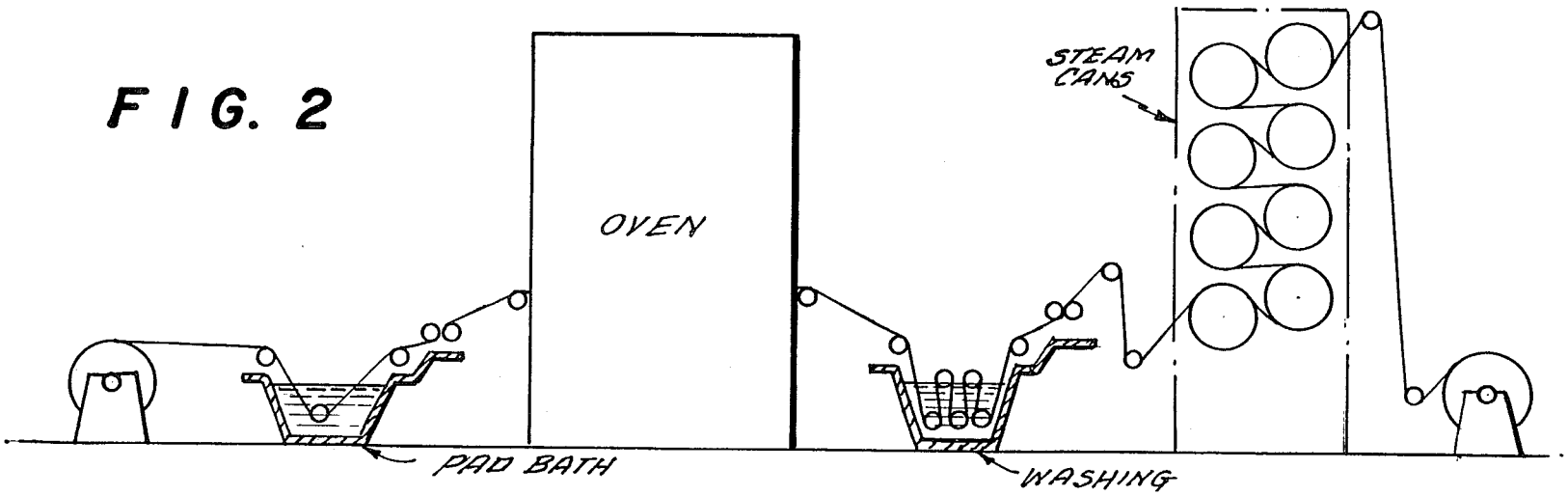
FIG. 2 is a schematic illustration of applying the dye and swelling agent from a pad bath onto the fabric, drying and fixing the fabric in a tenter oven, followed by washing and drying on a stack of steam cans.
Figure 3:
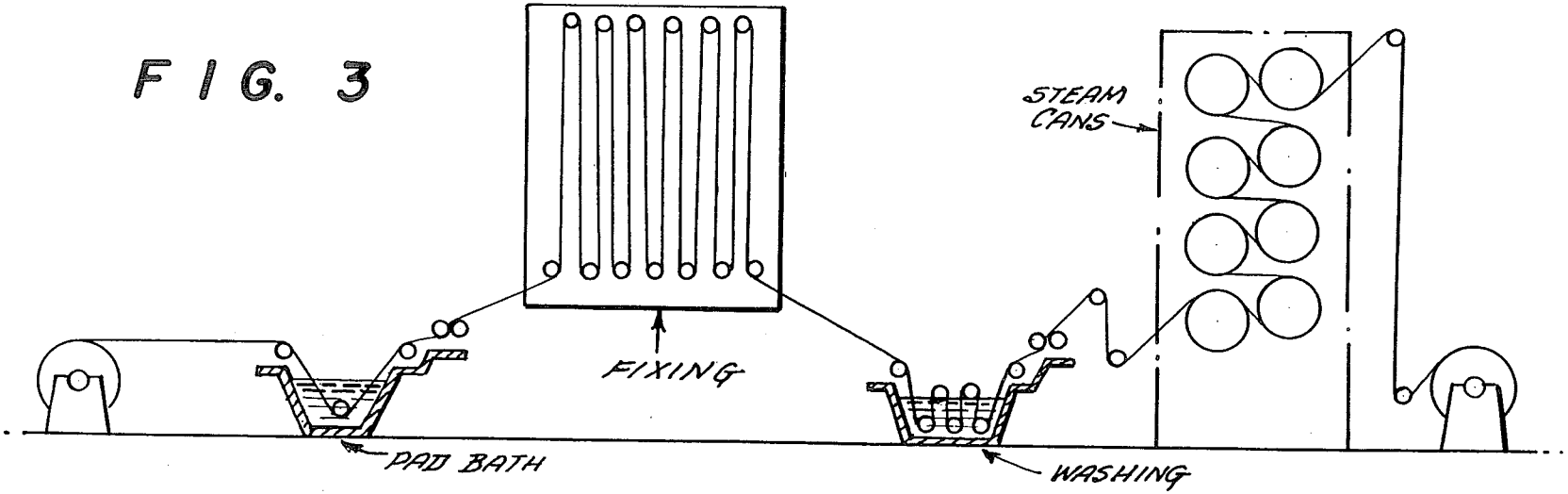
FIG. 3 is a schematic illustration of applying the dye pad bath at elevated temperature to a fabric, holding the fabric at ambient conditions for a period of time to fix the dye, followed by washing and drying.
Figure 4:
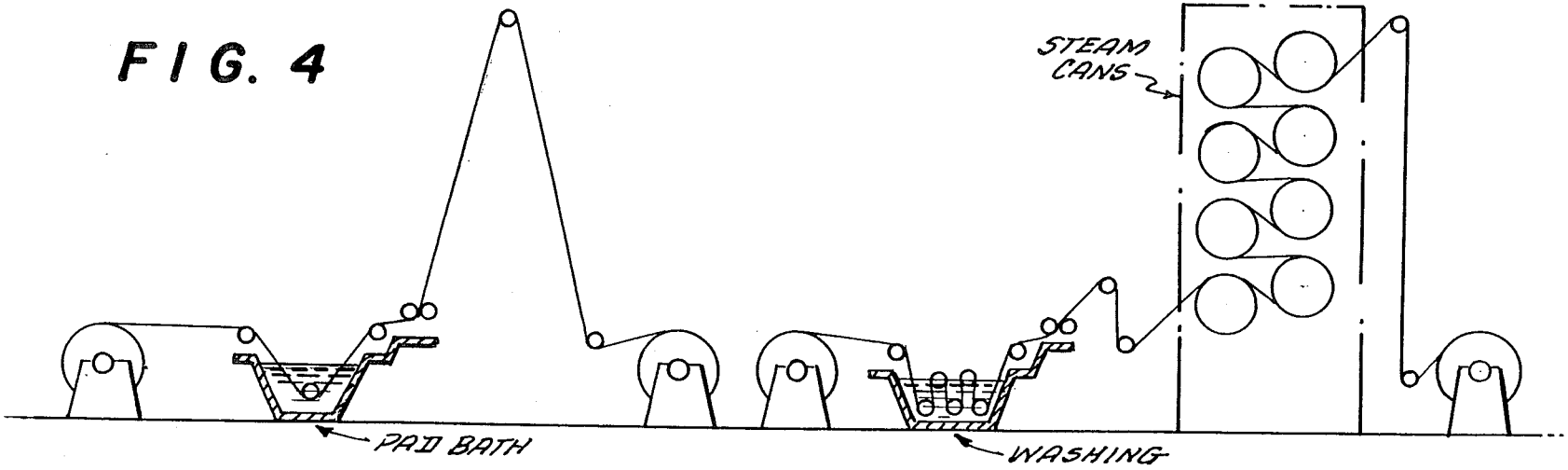
FIG. 4 is a schematic illustration of dyeing a fabric on a semi-continuous basis at an elevated temperature by padding the dye and swelling agent onto the fabric, batching the wet fabric on a roll for an extended period of time to fix the dye, then unwinding, washing and drying the dyed fabric.

Disclosed is a process for the continuous or semi-continuous dyeing of poly(m-phenyleneisophthalamide) fibers that includes the step of introducing the fiber into a fiber swelling agent solution also containing at least one dye, thereby swelling the fiber and introducing the dye into the fiber while in the swollen state.

Fiber swelling is accomplished in an aqueous solution of one or more fiber swelling agents. The following polar organic solvents have been found to be preferred swelling agents for poly(m-phenyleneisophthalamide) fiber:

N-methylpyrrolidone
dimethylsulfoxide (DMSO)
dimethylacetamide (DMAc)

Conveniently, these swelling agents are mixed with a compatible diluent, usually water, in various amounts; the swelling agent is present in a major amount, that is, more than half of the total weight of the solution. As an illustration, we have obtained good dye fixation in a continuous pad-oven-dry process using dimethylsulfoxide (DMSO) and water in ratios of DMSO:water of 70:30 to 90:10 with best results at the 90:10 level.

Fibers suitable for the continuous dyeing process of this invention are known generally as aromatic polyamides. This class includes a wide variety of polymers as disclosed in U.S. Pat. No. 4,324,706, the disclosure of which is incorporated by reference. Our experience indicates that not all types of aromatic polyamide fibers can be reproducibly dyed by this process; those fibers that are not modified by the organic polar solvent/-swelling agent and do not allow the dye to enter the fiber are only surface stained and are not fully dyed. Thus the fibers amenable to the process of this invention are made from a polymer known chemically as poly(m-phenyleneisophthalamide), i.e. the meta isomer which is the polycondensation product of metaphenylenediamine and isophthalic acid. Below is a listing of fibers now commercially available identified by fiber name (usually a trademark) and producer:

| Fiber Name | Producer |
|---|---|
| Nomex | DuPont |
| Apyeil (5207) | Unitika |
| Apyeil-A (6007) | Unitika |
| Conex | Teijin |

Selection of a suitable aromatic polyamide amenable to the continuous dyeing process of this invention can be conveniently made by subjecting a fiber sample to an abbreviated test to determine fiber dyeability. Our experience indicates that fibers of the para isomer, poly(p-phenyleneterephthalamide), represented commercially by duPont's Kevlar and Enka-Glanzstoff's Arenka, as well as Rhone-Poulenc's Kermel and polybenzimidazole (PBI), are merely stained or changed in color but are not dyed by the process of this invention. Accordingly, as used in the text of this application and in the claims that follow, the expressions "aramid" and "aromatic polyamide fiber", when pertaining to the novel process of this invention, will signify the meta isomer. Blends of poly(m-phenyleneisophthalamide) fibers with other fibers, including fibers of the para isomer, may be subjected to the dyeing process in which case only the meta isomer fibers will be dyed.

The polar organic solvent used in the continuous dyeing process of this invention has the ability to swell the aromatic polyamide fiber to be dyed with minimum or no damage to the fiber itself. Many polar organic solvents will successfully swell aromatic polyamide fibers to introduce a dye into the fiber but damage the fiber itself and are thus unsuited for use in undiluted form. Fiber damage can be mitigated or avoided by including an otherwise inert and compatible diluent such as water in the swelling agent system.

An important application of fabrics made of aramid fibers is the protection of military personnel. To be fully acceptable for military applications, dyed aromatic polyamide fibers must meet minimum strength requirements as defined in MIL-C-83429A for solution dyed fabrics. For convenience, comparison of the undyed (greige)T-455 fabric with the solution-dyed T-456 fabric and the dyed fabric resulting from the process herein described will be made. Highly polar organic solvents are notorious for degrading mechanical properties of aramid-type fibers, possibly by dissolving or solvating the polymer. To accommodate for this potential concern, the swelling agent system selected, when used at the appropriate temperatures and under the usual processing conditions, will result in a dyed aromatic polyamide fiber or fabric exhibiting at least 80%, preferably at least 90% if not identical to the strength of either the greige T-455 fiber or fabric as the case may be. Expressed conversely, the successfully dyed fiber or fabric exhibits no more than a 20% loss in strength, and preferably far less strength loss, and still will be acceptable for most applications.

The swelling agent system is composed of at least two components: (1) an organic polar solvent, and (2) a compatible, miscible "inert" diluent (inert in the sense that it does not itself enter into the dyeing process or interfere with the dyeing process) to minimize any damage that the polar organic solvent may cause to the fiber. It will be appreciated that the proportion of organic solvent to diluent, as well as the identity of each of the components, will vary depending upon several factors including the color to be achieved and the nature of the specific poly(m-phenyleneisophthalamide) fiber to be dyed, among others. Suitable swelling agents are selected from dimethylsulfoxide (DMSO), dimethylacetamide (DMAc), and N-methylpyrrolidone; DMSO is preferred. Suitable inert diluents include water, xylene (ortho, meta or para-dimethylbenzene), lower alkene glycols such as ethylene glycol and propylene glycol, alcohols such as n-propanol, methanol, benzyl alcohol, 4-butyrolactone, all of which are compatible with DMSO as the swelling agent, or other relatively high boiling organic liquids otherwise suited to the dyeing process. The selection of swelling agent and diluent is guided by optimum color yield balanced with minimum fiber damage.

While we do not wish to be bound to any particular theory or mode of operation, our experience leads us to believe that the swelling agent modifies the aromatic polyamide fiber by allowing the dye to enter the fiber. Examination by mass spectroscopy fails to reveal any swelling agent (DMSO) in a fiber dyed by the process of this invention. The mechanism of dye attachment to the fiber is less clear but is believed to be a physical entrapment rather than a chemical covalent bonding. The absence of swelling agent in the fiber following treatment provides an odor-free product, allowing the swelling agent to be more efficiently recovered and permits practice of the invention without untoward environmental concerns.

The particular type of dyestuff used in the process is not critical and may be selected from acid, mordant, basic, direct, disperse and reactive, and probably pigment or vat dyes. Especially good results with high color yields are obtained with the following classes of dyes, particular examples given parenthetically: acid dyes (Acid Green 25), mordant dyes (Mordant Orange 6), basic dyes (Basic Blue 77), direct dyes (Direct Red 79), disperse dyes (Disperse Blue 56) and reactive dyes (Reactive Violet 1). Mixtures of two or more dyes from the same class or two or more dyes of different classes are contemplated. The dye selected will be compatible with and function effectively in the swelling agent system.

In addition to the swelling agent, the inert diluent(s) and the dye, the customary dye pad bath additives and auxiliaries may be included, such as fire retardants, softeners (to improve hand), UV absorbing agents, IR absorbing agents, antistatic agents, water repellants, anti-foaming agents, and the like. Alternatively, these and other treatments may be applied to the fabric as a post-treatment finish after dyeing, heating, washing and drying are completed. Preferably the dyed fabric is water washed to remove any residual swelling agent remaining on the fabric. Typically, the wash water remains clear (uncolored) indicating good dye fixation.

Greige fibers that are dyed by the process of this invention (as distinguished from solution-dyed fibers in which a coloring agent is included in the molten resin prior to fiber formation) are virtually free of acetophenone, chlorinated solvents such as perchlorethylene, and other toxic solvent residues. As an example, residual DMSO amounts in fibers dyed by the process of this invention have been measured at less than 0.012 ppm. The dyed fibers have a strength retention of at least 80% of the undyed fibers. These properties distinguish products produced by our process from aramids dyed by the conventional process, using acetophenone as a dye carrier, which retain that solvent tenaciously, and Nomex dyed by the STX process in which the fibers retain small amounts of perchloroethylene.

The physical form of the fiber to be dyed is also open to wide variation at the convenience of the user. Most dyeing operations and equipment are suited to treatment of woven or knit fabrics in the open width as illustrated in FIGS. 1–4. It is also possible to slasher dye the fibers in yarn form and thereafter weave or knit the yarns into the item desired.

The invention will now be explained with reference to the following examples:

EXAMPLE I

Continuous dyeing of Type 455 woven NOMEX in open width was accomplished as follows: a pad bath was prepared containing 90 parts by weight DMSO and 10 parts by weight water to which was added 2.5% CI Acid Blue 171. The dyebath was padded onto style S/57344 NOMEX at 180° F. from a heated bath at a speed of 18 yards per minute and maintained in contact with the fabric under ambient conditions for a dwell time of 30 minutes. The fabric was then rinsed in water at 120° F. and dried.

The fabric was dyed a navy shade: dye fixation was very good and there was little mark-off on carrier rolls in the range. Three styles of NOMEX were run. Superior fixation and physical testing data are reported in the following tables. As used in Table I, "Color retention %" represents the percentage of color retained by the treated fabric after scouring at the boil, and after five launderings, respectively. For all three styles of fabric the percentage of RET was 95%+. Little to no color was removed during the rinse at 120° F. subsequent to dyeing.

Color difference was evaluated side-center-side, face to back and end to end. For comparison, physical data for undyed NOMEX (greige fabric) is included in Table II.

TABLE I

| | | 1 | | 2 | | | 3 | |
|---|---|---|---|---|---|---|---|---|
| | | Begin | End | Begin | Middle | End | Begin | End |
| Weight oz/sq yd | | 7.85 | 7.59 | 5.14 | 5.13 | 5.21 | 7.30 | 7.08 |
| Count | ends | 78 | 79 | 74 | 74 | 74 | 42 | 48 |
| yarns/inch | picks | 63 | 60 | 51 | 50 | 50 | 42 | 47 |
| Breaking strength | warp | 141.0 | 145.8 | 106.8 | 108.5 | 111.0 | 152.2 | 85.5 |
| 1" strips (lbs) | fill | 108.2 | 108.5 | 75.2 | 71.5 | 69.1 | 145.1 | 78.8 |
| Lightfastness | 20 hrs | 5.0 | 4.5 | 4.5 | 4.5 | 4.5 | 5.0 | 5.0 |
| Xenon (class) | 40 hrs | 5.0 | 4.0 | 4.0 | 4.0 | 4.0 | 4.5 | 4.5 |
| Colorfastness | nylon | 3.0 | 3.5 | 3.5 | 4.0 | 3.5 | 3.5 | 3.5 |
| AATCC IIIA wash stain - class | other fib. | 5.0 | 5.0 | 5.0 | 5.0 | 5.0 | 5.0 | 5.0 |
| Crockfastness | wet | 5.0 | 5.0 | 5.0 | 5.0 | 5.0 | 5.0 | 5.0 |
| class | dry | 5.0 | 5.0 | 5.0 | 5.0 | 5.0 | 5.0 | 5.0 |
| Flammability | warp | 0.7 | 0.7 | 0.8 | 0.7 | 0.8 | 0.7 | 0.7 |
| FTM 5903 - char (") | fill | 0.6 | 0.5 | 0.7 | 0.8 | 0.8 | 0.7 | 0.6 |
| Color retention % | scour | 97.34 | 103.56 | 101.96 | 100.98 | 102.25 | 101.24 | 102.01 |
| after | 5 la | 85.15 | 93.88 | 94.64 | 89.56 | 95.02 | 91.53 | 89.53 |

The above data demonstrate that the ends/picks and weight were increased by the process. Breaking strength was not significantly decreased and flammability for the dyed product was better than the undyed control. Washfastness and crockfastness were both good; Xenon light fastness was comparable with solution dyed NOMEX.

EXAMPLE II

Using the arrangement depicted in FIG. 1, Type 455 woven NOMEX was dyed in a pad bath containing 90 parts by weight DMSO and 10 parts by weight water. In a first run Safety Yellow was the shade; Olive Green was used in the second run. The pad bath was applied at 180° F. then passed over a series of steam cans at 220° F. to fix the dye followed by washing in water and drying. Visual observations were favorable; test data including solution dyed NOMEX and greige (undyed) NOMEX for comparison are as follows:

TABLE II

| TEST METHOD | TEST | | T-458 | GREIGE T-455 | YELLOW T-455 | GREEN T-455 |
|---|---|---|---|---|---|---|
| FTM 5041 | WEIGHT | OZ/SQ/YD | 4.36 | 4.48 | 4.94 | −4.84 |
| FTM 5050 | COUNT | ENDS | 69 | 69 | 74 | 73 |
| | YARNS/INCH | PICKS | 48 | 47 | 48 | 48 |
| FTM 5100 | BREAKING | WARP | 207.2 | 185.7 | 176.3 | 192.0 |
| | STRENGTH | FILL | 148.3 | 143.3 | 127.5 | 138.6 |
| AATCC | CROCKFASTNESS | WET | 5.0 | | 5.0 | 5.0 |
| 1981 | | DRY | 5.0 | | 5.0 | 5.0 |
| AATCC | LIGHTFASTNESS | 20 HOURS | 4.5 | | 2.5 | 5.0 |
| 18E-1982 | XENON | 40 HOURS | 4.0 | | 1.5 | 4.5 |

TABLE II-continued

| TEST METHOD | TEST | | | T-458 | GREIGE T-455 | YELLOW T-455 | GREEN T-455 |
|---|---|---|---|---|---|---|---|
| AATCC 81-1980 IIIA | WASHFASTNESS STAINING | | WOOL | 5.0 | | 5.0 | 3.5 |
| | | | ORLON | 5.0 | | 5.0 | 5.0 |
| | | | DACRON | 5.0 | | 5.0 | 5.0 |
| | | | NYLON | 4.5 | | 5.0 | 3.0 |
| | | | COTTON | 4.5 | | 5.0 | 5.0 |
| | | | ACETATE | 4.5 | | 5.0 | 5.0 |
| FTM 5903 | FLAMMABILITY | WARP | AFTER FLAME | 0.0 | 0.0 | 0.0 | 0.0 |
| | | | AFTER GLOW | 12.0 | 0.0 | 3.0 | 0.0 |
| | | | CHAR | 3.0 | 1.4 | 3.2 | 2.6 |
| | | FILL | AFTER FLAME | 0.0 | 0.0 | 0.0 | 0.0 |
| | | | AFTER GLOW | 11.0 | 0.0 | 3.0 | 6.0 |
| | | | CHAR | 2.6 | 1.1 | 3.1 | 2.6 |
| FTM 5905 MODIFIED | FLAMMABILITY | WARP | CLASS* | B | B | B | B |
| | | | AFTER FLAME 1 | 0.0 | 3.7 | 0.0 | 0.0 |
| | | | AFTER FLAME 2 | 0.0 | 0.0 | 0.0 | 0.0 |
| | | | % CONSUMED | 39.0% | 34.2% | 10.8% | 8.3% |
| | | FILL | CLASS* | B | B | B | B |
| | | | AFTER FLAME 1 | 8.0 | 12.0 | 0.0 | 0.0 |
| | | | AFTER FLAME 2 | 0.0 | 0.0 | 0.0 | 0.0 |
| | | | % CONSUMED | 39.0% | 41.7% | 12.5% | 16.7% |
| | % SHRINKAGE AFTER 15 Lo @140 F | | WARP | 3.0% | 7.8% | 4.0% | 3.5% |
| | | | FILL | 0.0% | 2.5% | 2.0+% | 3.0+% |

*B - IGNITES BUT IS SELF EXTINGUISHING

The above data confirm visual inspection of the fabric after dyeing. Retention and endurance, expressed as percent color retained after scouring at the boil and after a IIIA wash were 90+%. Dye fixation with a single pass over steam cans was excellent; penetration or coverage in yarn crossover areas was improved with the use of steam cans over fixation at ambient conditions for 30 minutes of Example I. Shade control was good—side-center-side shading codes approached 5-5-5; end-to-end shading on the yellow was not as good as on the green.

Figure 5:
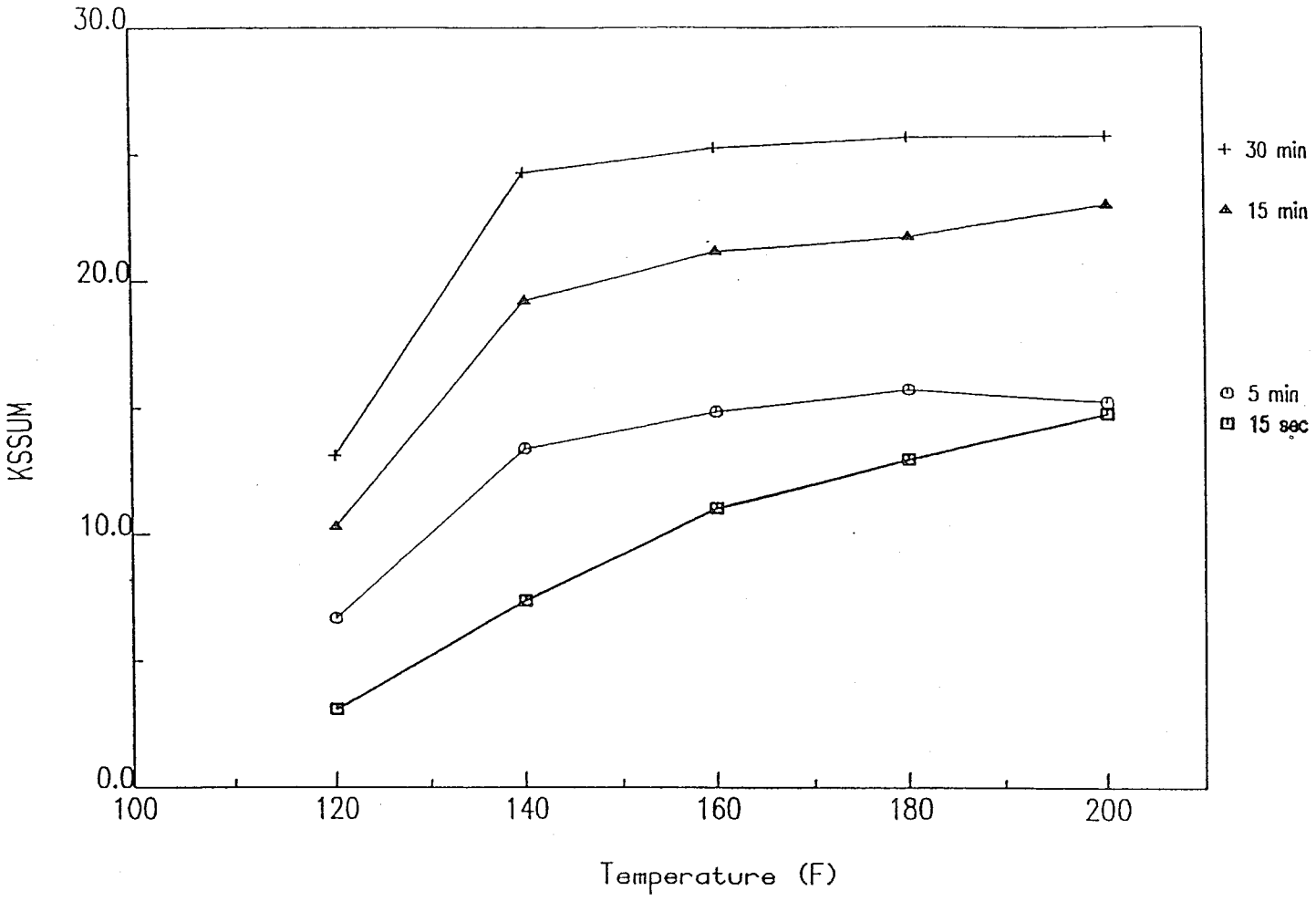
FIG. 5 is a graph comparing treatment or "dwell" time and temperature of poly(m-phenyleneisophthalamide) fibers in the fiber swelling agent/dye with function of reflectance value (KSSUM) as a measure of color.

The continuous dyeing process of this invention is time and temperature dependent—higher temperatures and longer treatment times favor higher reflectance values, expressed in the graph of FIG. 5 as KSSUM, a measure of color. Highest KSSUM values are obtained where the treatment time is at least 30 minutes and the dyebath is at least 140° F.; this value improves slightly as the temperature increases (see the line connecting the + data points). By contrast, very short treatment times (box line) achieve only about half the KSSUM values even at treatment temperatures of 200° F. This information together with related data and comparisons will provide the operator with ample guidance to carry out the process of the invention.

Other embodiments of the invention in addition to those specifically described and exemplified above will be apparent to one skilled in the art from a consideration of the specification or the practice of the invention disclosed herein. It is intended that the specification and examples be considered as exemplary only, with the true scope and spirit of the invention being indicated by the claims that follow.

What is claimed:

1. A process for continuously dyeing a poly(m-phenyleneisophthalamide) fiber, comprising the steps of:

(1) contacting a dyeable poly(m-phenyleneisophthalamide) fiber with a solution of a dye dissolved in an organic swelling agent adapted to swell said fiber and selected from the group consisting of N-methylpyrrolidone, dimethylsulfoxide, and dimethylacetamide, and a diluent, selected from the group consisting of water, xylene, ethylene glycol, lower alcohols and 4-butyrolactone in which the weight ratio of swelling agent to diluent is from about 70:30 to 90:10, the solution maintained at a temperature in the range of about 65° F. to about 200° F.;

(2) heating the poly(m-phenyleneisophthalamide) fiber treated in step (1) to fix said dye to said fiber;

(3) washing the fiber to remove any residual dye and organic swelling agent; and (4) drying the fiber.

2. The process of claim 1, in which the solution contains a mixture of dimethylsulfoxide and water.

3. The process of claim 2, in which said solution contains a mixture of dimethylsulfoxide and water in a weight ratio of about 90:10.

4. A process of continuously dyeing a poly(m-phenyleneisophthalamide) fiber comprising the sequential steps of:

(a) contacting a dyeable poly(m-phenyleneisophthalamide) fiber with a dyebath solution containing (1) an organic polar solvent swelling agent selected from the group consisting of diemthylsulfoxide, N-methylpyrrolidone and dimethylacetamide, (2) a compatible inert diluent selected from the group consisting of water, xylene, ethylene glycol, lower alcohols and 4-butyrolactone to dilute the swelling agent and protect the fiber from degradation, and (3) a dye dissolved in the solution, provided that the swelling agent is adapted to swell the fiber and allow the dye to enter into and become fixed in the fiber, and the swelling agent and inert diluent are present in proportions such that the mechanical strength of the dyed fiber is at least 80% of the strength of untreated fiber, (b) heating the fiber to fix the dye in the fiber;

(c) washing the fiber to remove residual dye and organic swelling agent; and (d) drying the fiber.

5. The process of claim 4 in which the dye (3) is selected from the group consisting of acid dyes, mordant dyes, basic dyes, direct dyes, disperse dyes and reactive dyes.

6. The process of claim 4 in which step (a) is conducted at a temperature in the range of from room temperature up to about 200° F.

7. The process of claim 4 in which the strength of the dyed fiber is at least 90% of the strength of an untreated fiber.

8. The process of claim 4 in which the weight ratio of swelling agent (1) to inert diluent (2) is from about 70:30 to about 90:10.

9. The process of claim 4 in which the swelling agent (1) is dimethylsulfoxide and the diluent (2) is water.

10. Fibers of poly(m-phenyleneiso-phthalamide) dyed by the process of claim 4.

11. A process for the continuous dyeing of a poly(m-phenyleneisophthalamide) fiber comprising the steps of:

(i) contacting a solvent-swellable, dyeable poly(m-penyleneisophthalamide) fiber with a liquid swelling agent system containing a dye dissolved in an organic swelling agent selected from the group consisting of dimethylsulfoxide, N-methylpyrrolidone, and dimethylacetamide and an inert diluent selected from the group consisting of water, xylene, ethylene glycol, lower alcohols and 4-butyrolactone and allowing the thus contacted fiber to swell and admit the dye into the swollen fiber;

(ii) heating the fiber to fix the dye in the fiber; and (iii) washing the fiber to leave substantially no liquid swelling agent in the fiber.

12. The process of claim 11 in which the dyed fiber has at least 80% of the strength of the undyed, untreated poly(m-phenyleneisophthalamide) fiber.

13. The process of claim 12 in which the dyed fiber has at least 90% of the strength of the undyed, untreated poly(m-phenyleneisophthalamide) fiber.

14. The process of claim 11 in which the dyeing in step (i) is conducted at a temperature in the range of from room temperature up to about 200° F.

15. A process for the continuous dyeing of a fabric comprising poly(m-phenyleneisophthalamide) fibers to a level shade, said process comprising the steps of:

(1) applying a dye solution of at least 70 parts by weight of an organic swelling agent selected from the group consisting of N-methylpyrrolidone, dimethylsulfoxide and dimethylacetamide, an inert diluent selected from the group consisting of water, xylene, ethylene glycol, lower alcohols and 4-butyrolactone and a tinctorial amount of a dyestuff dissolved in the solution, to a woven or knit fabric containing poly(m-phenyleneisophthalamide) fibers, the dye solution applied at a temperature in the range of from room temperature up to about 200° F.;

(2) heating the fabric to fix the dye in the poly(m-phenyleneisophthalamide) fibers;

(3) washing the heated fabric to remove any residual dye or organic swelling agent from the fabric; and (4) drying the thus treated fabric.

16. A woven or knit fabric in which the poly(m-phenyleneisophthalamide) fibers are dyed by the process of claim 15.

17. A process for continuously dyeing a poly(m-phenyleneisophthalamide) fiber, comprising the steps of:

(1) contacting a dyeable poly(m-phenyleneisophthalamide) fiber with a heated solution of a dye dissolved in an organic swelling agent adapted to swell said fiber and selected from the group consisting of N-methylpyrrolidone, dimethylsulfoxide and dimethylacetamide and a diluent selected from the group consisting of water, xylene, ethylene glycol, lower alcohols and 4-butyrolactone, in which the weight ratio of swelling agent to diluent is from about 70:30 to 90:10, the solution maintained at a temperature in the range of about 140° F. to about 200° F.;

(2) holding the fiber treated in step (1) at ambient temperature for a time sufficient to fix said dye to said fiber;

(3) washing the fiber to remove any residual dye and organic swelling agent; and (4) drying the fiber.

18. The process of claim 17, in which the solution contains a mixture of dimethylsulfoxide and water in a weight ratio of about 90:10.

19. A process of continuously dyeing a poly(m-phenyleneisophthalamide) fiber comprising the sequential steps of:

(a) contacting a dyeable poly(m-phenyleneisophthalamide) fiber with a heated dyebath solution maintained at a temperature in the range of about 140° F. to about 200° F., the dyebath solution containing (1) an organic polar solvent swelling agent selected from the group consisting of dimethylsulfoxide, N-methylpyrrolidone and dimethylacetamide, (2) a compatible inert diluent selected from the group consisting of water, xylene, ethylene glycol, lower alcohols and 4-butyrolactone to dilute the swelling agent and protect the fiber from degradation, and (3) a dye dissolved in the solution, provided that the swelling agent is adapted to swell the fiber and allow the dye to enter into and become fixed in the fiber, the weight ratio of swelling agent to diluent is from about 70:30 to 90:10, and the swelling agent and inert diluent are present in proportion such that the mechanical strength of the dyed fiber is at least 80% of the strength of untreated fiber, and (b) holding the fiber at ambient temperature for a time sufficient to fix the dye in the fiber;

(c) washing the fiber to remove residual dye and organic swelling agent; and (d) drying the fiber.

20. The process of claim 19, in which the dye (3) is selected from the group consisting of acid dyes, mordant dyes, basic dyes, direct dyes, disperse dyes and reactive dyes.

21. The process of claim 19, in which the strength of the dyed fiber is at least 90% of the strength of an untreated fiber.

22. The process of claim 19 in which the swelling agent (1) id dimethylsulfoxide and the diluent (2) is water.

23. A process for the continuous dyeing of a poly(m-phenyleneisophthalamide) fiber comprising the steps of:

(i) contacting a solvent-swellable, dyeable poly(m-phenyleneisophthalamide) fiber with a heated liquid swelling agent system containing a dye dissolved in an organic swelling agent selected from the group consisting of dimethylsulfoxide, N-methylpyrrolidone, and dimethylacetamide and an inert diluent selected from the group consisting of water, xylene, ethylene glycol, lower alcohols and 4-butyrolactone in a swelling agent to inert diluent ratio of from about 70:30 to 90:10 while the liquid is maintained at a temperature in the range of from about 140° F. to about 200° F. and allowing the thus contacted fiber to swell and admit the dye into the swollen fiber;

(ii) holding the fiber at ambient temperature for a time sufficient to fix the dye to the fiber; and (iii) washing the fiber to leave substantially no liquid swelling agent in the fiber.

24. A process for the continuous dyeing of a fabric comprising poly(m-phenyleneisophthalamide) fibers to a level shade, said process comprising the steps of:

(1) applying a heated dye solution containing at least 70 parts by weight of an organic swelling agent selected from the group consisting of N-methylpyrrolidone, dimethylsulfoxide and dimethylacetamide, at least 10 parts by weight of an inert diluent selected from the group consisting of water, xylene, ethylene glycol, lower alcohols and 4-butyrolactone, and a tinctorial amount of a dyestuff, to a woven or knit fabric containing poly(m-phenyleneisophthalamide) fibers, the dye solution applied at a temperature in the range of from 140° F. to about 200° F.;

(2) holding the fabric at ambient temperature for a period of time sufficient to fix the dye in the poly(m-phenyleneisophthalamide) fibers;

(3) washing the heated fabric to remove any residual dye or organic swelling agent from the fabric; and (4) drying the thus treated fabric.

* * * * *